United States Patent [19]

Fabian et al.

[11] 3,992,916

[45] Nov. 23, 1976

[54] INTAKE DEVICE FOR A BAND ROLLING MILL

[75] Inventors: Wolfgang Fabian, Dortmund-Hombruch; Konrad Klein, Dortmund-Wambel; Theodor Sevenich; Hans Wladika, both of Dortmund, all of Germany

[73] Assignee: Hoesch Werke Aktiengesellschaft, Dortmund, Germany

[22] Filed: Oct. 1, 1975

[21] Appl. No.: 618,501

[30] Foreign Application Priority Data

Oct. 16, 1974 Germany ..... 2449199

[52] U.S. Cl. ..... 72/251

[51] Int. Cl.[2] ..... B21B 39/12

[58] Field of Search ..... 72/251, 250, 227

[56] References Cited

UNITED STATES PATENTS 1,981,146 11/1934 Larsen ..... 72/251 X 2,062,297 12/1936 Delaney ..... 72/251 X

*Primary Examiner*—Milton S. Mehr

*Attorney, Agent, or Firm*—Walter Becker

[57] ABSTRACT

An intake device for a band rolling mill, which includes an upper driving roller and a lower driving roller adjustable relative to each other and forming with each other a bite into which the band to be rolled is fed by the driven rollers of a lower roller bed and the driven rollers of an upper roller bed while both roller beds form with each other a wedge-shaped feeding funnel pointing toward the bite formed by the upper and lower driving rollers. The angle which the upper and lower roller beds form with each other is variable at will.

7 Claims, 2 Drawing Figures

INTAKE DEVICE FOR A BAND ROLLING MILL

The present invention relates to a mill hopper with an intake roller bed which precedes a driving device in a band rolling mill, especially a wide band rolling mill with band-winding machines.

In a manner known per se, ahead of the driving devices in band rolling mills, especially wide band rolling mills, respectively associated with underground reels there are above the roller bed arranged sheets which together with the rollers located ahead of the lower driving roller and pertaining to the outlet roller bed or the intake roller bed form a funnel which has its tip directed toward the gap between the lower and the upper driving roller. By means of this funnel it is intended to guide the front ends of the bands coming from the last rolling frame into the driving device. If, however, the band front ends turn over on the outlet roller bed, a situation which frequently occurs, the folded-over band front ends get stuck in the funnel because the friction of the folded-over front end of the band in the intake funnel is too great. These known intake funnels also have the drawback that the distance of the last roller bed roller from the lower driving roller is too great in order safely to transport a band front end moved into the funnel, even if it is not folded over. If, however, a band gets stuck in the intake funnel, the entire rolling operation has to be stopped until the intake funnel is again free. This may, under certain circumstances represent a considerable production loss.

It is, therefore, an object of the present invention to avoid the above mentioned drawbacks of heretofore known intake funnels and so to design such funnels that the front ends of the bands moving into the intake funnel, especially folded over band front ends, can safely be transported into the gap between the lower and upper driving roller and therefore to the reel.

These and other objects and advantages of the invention will appear more clearly from the following specification in connection with the accompanying drawings, in which.

Figure 1:
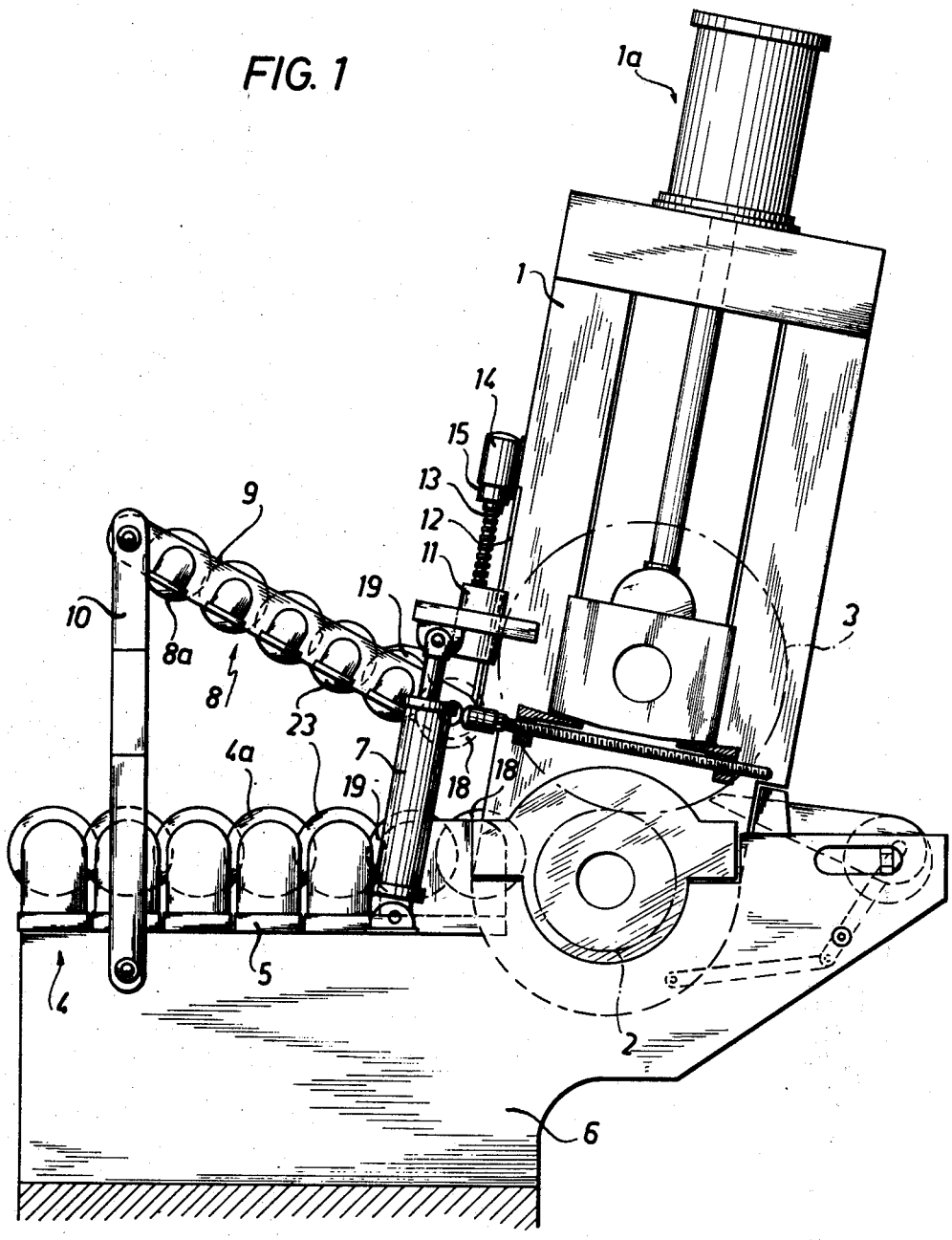
FIG. 1 is a side view of a driving device according to the invention.

The driving device according to the present invention is characterized in that above the intake roller bed with driven rollers there is provided another roller bed with driven rollers which last mentioned roller bed is pivotally mounted at both ends and is inclined toward the intake roller bed in the direction of the driving device and is adjustable as to height. Advantageously, the frame of the upper roller bed is adjustable as to height in a sliding member which is arranged on the stand of the driving device, and is linked to said sliding member. The other end of said frame is pivotally connected to a shoe which latter is pivotally connected to the foundation of the intake roller bed.

According to a further development of the invention, the sliding member is guided in guiding means provided in the stand and is connected to a threaded spindle which is driven by a motor through the intervention of a transmission.

Expediently, the drive of the rollers comprising a motor and clutch is from roller to roller arranged alternately on one and the other side adjacent the roller bed. In order to be able to arrange the last roller bed rollers up to the region of the driving rollers, advantageously the respective last two rollers of the two roller beds are driven together by the motor of the respective preceding roller. Advantageously, these rollers may, through the intervention of sprocket wheels and chains be interconnected and may be connected to the respective preceding roller. The front ends of the bands are prevented from hitting the rollers by designing the rollers as disc rollers and providing the same with intermeshing teeth.

Referring now to the drawings in detail, when viewing the device in the direction of movement of a band, a roller bed 4 representing the intake roller bed is provided ahead of a driving device with the stand 1 and the lower driving roller 2 as well as the upper driving roller 3. The frame 5 of the roller bed 4 is connected to the foundation 6. For purposes of pivoting or tilting the stand 1 or the upper driving roller 3 supported thereby, there is provided a hydraulic cylinder 7 on which above the upper roller bed 4 there is arranged a further roller bed 8 the frame 9 of which is on one hand supported by a shoe 10 which is pivotally connected to the foundation 6 on the intake side so as to be able to pivot. On the other hand, the frame 9 is adjustably and pivotally mounted on a sliding member 11 movable on the stand 1.

The sliding member 11 is guided in guiding means provided on the stand 1 and by means of a threaded spindle 13 is movable upwardly and downwardly. The spindle 13 is adapted to be driven by a motor 14 by the intervention of a transmission 15.

Figure 2:
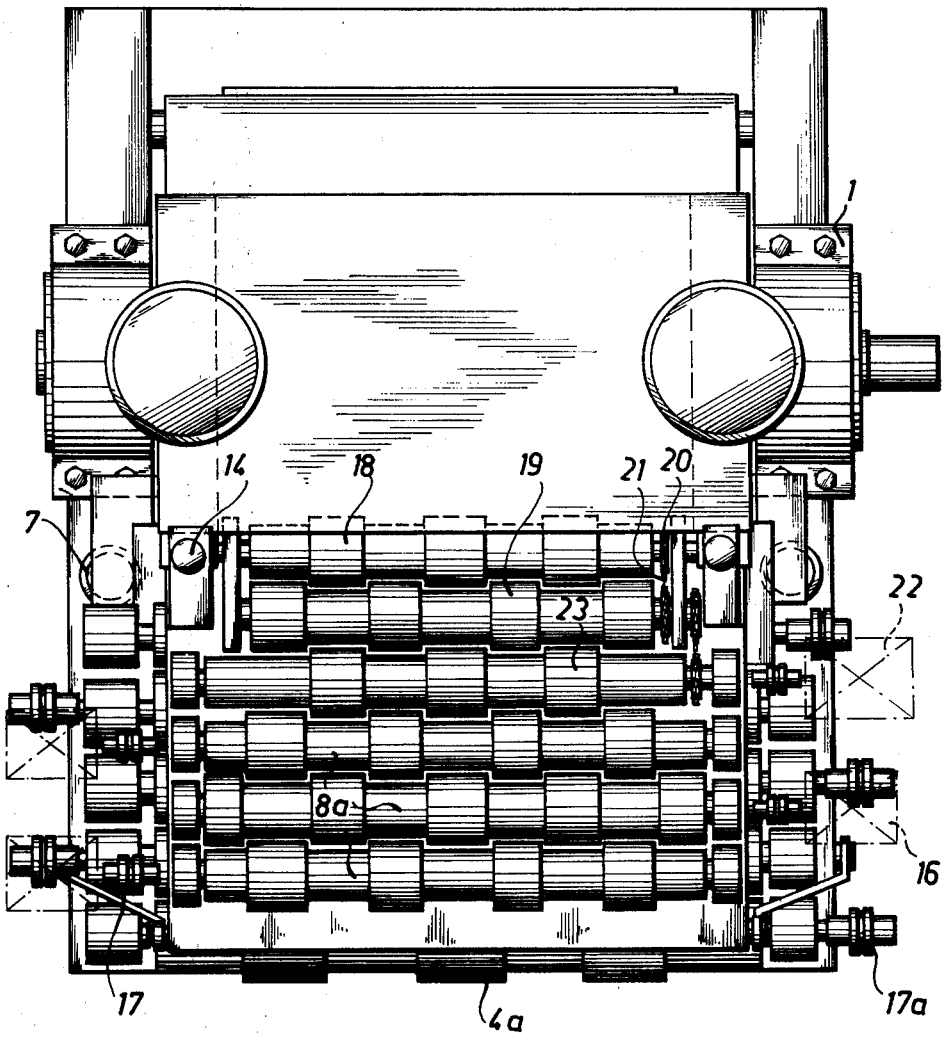
FIG. 2 is a top view of FIG. 1, but with the stand for the upper roller in vertical position.

The rollers **4*a* and 8*a* of the lower roller bed 4 and of the upper roller bed 8 are driven each by a motor 16 through the intervention of a clutch 17. The motors 16 are alternately from roller to roller arranged on one and the other side adjacent the roller bed 4 and 8. According to FIG. 1, the motors 16 and clutches 17 have been omitted for a clearer view. In FIG. 2, only the clutch 17a and roller 4a are visible of the roller bed 4. The respective last two rollers 18 and 19 of the upper and lower roller bed 4,8 ahead of the stand 1 of the driving device are driven together by the motor 20 of the preceding roller 23 through the intervention of sprocket wheels 20 and chains 21. To this end, the drive of the roller 23 is correspondingly stronger. The rollers 4*a*, 18, 19 and 23 of the lower roller bed 4 as well as the rollers 8*a*, 18, 19, 23 of the upper roller bed 8 are designed as disc rollers and are drivingly connected to each other as shown in FIG. 2. The roller 3 is adjustable relative to roller 2 by cylinder-piston means 1a**.

As will be evident from the above, the advantages of the intake funnel according to the invention consist primarily in that the moving-in front ends of the bands are safely conveyed into the gap between the driving rollers and thereby to the reel. Even folded over front ends of the bands are on their way through the inlet funnel deformed or stretched in such a way that they are safely grasped by the driving roller. This is due to the fact that a gap fitting the respective thicknesses of the band can easily be set between the last roller and the lower and upper roller bed. The structural steps are completed by the fact that the rollers of the upper roller bed are operated at a higher speed than the rollers of the lower roller bed.

It is, of course, to be understood that the present invention is, by no means, limited to the specific showing in the drawings but also comprises any modifications within the scope of the appended claims.

What we claim is:

1. An intake device for a band rolling mill, which includes: supporting means, a lower driving roller rotatably supported by said supporting means, a stand supported by: said supporting means, an upper driving roller supported by said stand and adjustable relative to said lower driving roller to form a bite therewith, a lower roller bed supported by said supporting means, and comprising a plurality of rollers arranged one behind the other and ahead of said lower driving roller when viewing the intended direction of movement of a band to be rolled into said bite, an upper roller bed having a plurality of rollers arranged one behind the other for cooperation with the rollers of said lower roller bed, said upper roller bed being arranged above said lower roller bed and having one end pivotally connected to said frame and having its other end movably supported by said stand and adjustable selectively toward and away from the adjacent end of said first roller bed for varying the angle between said first and second roller beds.

2. A device according to claim 1, which includes a sliding member slidable selectively upwardly and downwardly on said stand, and having said other end of said upper roller bed pivotally connected thereto, and link means pivotally connecting said one end of said upper roller bed to said supporting means.

3. A device according to claim 2, in which said stand has guiding means provided thereon for slidably guiding said sliding member, and which includes a threaded spindle drivingly connected to said sliding member, and also includes motor means drivingly connected to said spindle for selectively causing the latter to move said sliding member upwardly and downwardly in said guiding means.

4. A device according to claim 1, which includes driving means for the rollers of said upper and lower roller beds, said driving means including motor means and coupling means and alternately from roller to roller being arranged on different sides of the rollers of the respective roller bed.

5. A device according to claim 4, in which the last two rollers of each of said upper and lower roller beds which are closest to said upper and lower driving rollers are drivingly connected to the respective motor means pertaining to the respective roller preceding the respective last two rollers of the respective roller bed.

6. A device according to claim 5, which includes sprocket wheels and chain means for driving the rollers of the respective roller bed which are driven in common.

7. A device according to claim 1, in which the rollers of each of said roller beds are respectively designed as intermeshing disc rollers.

* * * * *

UNITED STATES PATENT OFFICE

CERTIFICATE OF CORRECTION

Patent No. 3,992,916 Dated November 23, 1976

Inventor(s) Wolfgang Fabian et al.

It is certified that error appears in the above-identified patent and that said Letters Patent are hereby corrected as shown below:

Column 2, line 21 "upper" should read -- lower --.

Column 3, line 7 after "by" cancel (:)

Column 3, line 10 after "means" cance the comma (,)

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*